US005915340A

United States Patent [19]

Cronin et al.

[11] Patent Number: 5,915,340

[45] Date of Patent: Jun. 29, 1999

[54] VARIABLE SECTOR PLATE QUAD SECTOR AIR PREHEATER

[75] Inventors: James P. Cronin, Wellsville; Thomas Gary Mergler, Bolivar, both of N.Y.

[73] Assignee: ABB Air Preheater Inc., Wellsville, N.Y.

[21] Appl. No.: 08/724,827

[22] Filed: Oct. 2, 1996

[51] Int. Cl.[6] ..... F23L 15/02; F28D 17/04

[52] U.S. Cl. ..... 122/1 A; 165/9; 165/10

[58] Field of Search ..... 122/1 A; 165/8, 165/9, 10

[56] References Cited

U.S. PATENT DOCUMENTS

| | | | |
|---|---|---|---|
| 3,799,242 | 3/1974 | Harris et al. . | |
| 5,137,078 | 8/1992 | Borowy | 165/9 |
| 5,456,310 | 10/1995 | Brophy et al. | 165/9 |

FOREIGN PATENT DOCUMENTS

| | | |
|---|---|---|
| 314 058 | 3/1974 | Austria . |
| 2 552 217 | 3/1985 | France . |
| 42 30 133 A1 | 3/1994 | Germany . |

OTHER PUBLICATIONS

International Search Report, International Application No. PCT/US 97/18124, Dec. 23, 1997.

*Primary Examiner*—Teresa Walberg
*Assistant Examiner*—Gregory A. Wilson
*Attorney, Agent, or Firm*—Alix, Yale & Ristas, LLP

[57] ABSTRACT

A sealing arrangement for a quad sector rotary regenerative air preheater has a rotor rotatably mounted in a housing. The rotor has radially extending diaphragms forming compartments and radial seals extending along the edges of the diaphragms. Sector plates are positioned at the axial ends of the rotor to divide the preheater into a flue gas sector, a primary air sector and a first secondary air sector adjacent said flue gas sector and said primary air sector, and a second secondary air sector positioned adjacent said flue gas sector and said primary air sector. The sector plates between the flue gas sector and said secondary air sectors are in sealing engagement with two of the radial seals at all times and the sector plates between the primary air sector and the secondary air sectors are in sealing engagement with only one of the radial seals at any particular time.

1 Claim, 6 Drawing Sheets

VARIABLE SECTOR PLATE QUAD SECTOR AIR PREHEATER

BACKGROUND OF THE INVENTION

The present invention relates to rotary regenerative air preheaters for the transfer of heat from a flue gas stream to a combustion air stream. More particularly, the present invention relates to a quad sector air preheater.

Rotary regenerative air preheaters are commonly used to transfer heat from the flue gases exiting a furnace to the incoming combustion air. Conventional rotary regenerative air preheaters have a rotor supporting heat transfer surfaces. The rotor is rotatably mounted in a housing. The rotor has radial partitions or diaphragms defining compartments therebetween for supporting the heat transfer elements. Sector plates extend across the upper and lower faces of the rotor to divide the preheater into a gas sector and an air sector. The hot flue gas stream is directed through the gas sector of the preheater and transfers heat to the heat transfer surfaces on the continuously rotating rotor. The heat transfer surfaces are then rotated to the air sector of the preheater. The combustion air directed over the heat transfer surfaces is thereby heated.

Large steam generators utilizing pulverized coal firing, typically employ a portion of the heated incoming combustion air for drying classification and transport of the coal in the pulverizer. It is normally required that coal be dried and pulverized before ignition can take place. The portion of the incoming air directed to the pulverizer is referred to as primary air. The remaining heated combustion air, referred to as secondary air, is directly sent to the steam generator.

In one prior embodiment, the primary air for the pulverizer is directed through a first preheater, and the secondary air for direct use in combustion is directed through a second preheater. Conventionally, to eliminate the costly and complex requirement of multiple preheaters, a single preheater having multiple air sectors has been used to eliminate the requirement for multiple air preheaters. These tri-sector preheaters have the air sector of the preheater subdivided by an additional air sector plate.

Radial sealing members along the edges of the partitions or diaphragms of the rotor wipe against the air-gas sector plates which divide the preheater into the flue gas sector and the air sector. The radial sealing members further wipe against the sector plate which divides the air sector of the preheater into the primary and secondary air sectors, sometimes referred to as the priair-secair sector plates. The sealing engagement of these radial seals with the sector plates minimizes the leakage and mixing of the flue gas stream with the air stream, and the primary air stream and secondary air stream. In order to keep the leakage as low as practicable, it is common to provide a double sealing arrangement between the rotor and the sector plates. In this arrangement, the air-gas sector plates and primary air-secondary air sector plate are equal in size to two rotor compartments. With this arrangement the radial seals on two consecutive partitions or diaphragms are in engagement with the sector plate at the same time.

A deficiency of conventional tri-sector preheaters is that the sector plates required for the double seal arrangement occupy or block off a non-trivial percentage of the flow area through the air preheater. This blockage reduces the flow area through the rotor and increases the pressure drop through the preheater requiring that the size of the preheater be increased to compensate.

The double sealing arrangement of the radial seals with the sector plates, along with axial seals arranged along the outer circumference of the rotor and the housing, prevent leakage of air and flue gas among the flue gas, primary air and secondary air sectors. Typically, the most significant air leakage among the sectors is direct leakage. Direct leakage is the quantity of air that passes between the radial and axial seals and sealing surfaces as a result of pressure differentials between the different air and flue gas streams. Conventionally, the primary air stream operates at the highest relative pressure in order to adequately dry and convey coal from the pulverizers. The secondary air stream is conventionally at a pressure greater than the ambient air pressure, but less than the pressure of the primary air steam. The flue gas stream is typically at a pressure below the ambient air pressure due to the downstream positioning of fans for the movement of the flue gas. Therefore, direct leakage typically occurs between the primary air sector and the flue gas sector and between the secondary air and flue gas sector, due to the differential pressures between the sectors.

Direct leakage can dilute or decrease the temperature of the flue gas by 10° F. to 20° F. The cooler combustion air stream can mix, through direct leakage, with the hotter flue gas stream to reduce the flue gas stream exit temperature. Reduced flue gas stream exit temperatures lower the cold end metal temperatures of the rotor. The cold end of the rotor can therefore fall below the dewpoint of the flue gas. Consequently, steel construction materials in the rotor are subject to corrosion from sulfuric acid as moisture condenses on the rotor in the presence of sulfur in the gas. As the percentage of sulfur in the coal rises, the amount of potential corrosion to the cold end increases. The corrosion can lead to more frequent replacement of corroded cold end components. Furthermore, for coal firing, fouling potential increases as the temperature decreases.

In addition, direct leakage between the air sector and the flue gas sector reduces air side flow. Therefore larger fans are required increasing initial and operating expenses.

SUMMARY OF THE INVENTION

The present invention relates to a rotary regenerative preheater having four sectors. The quad sector air preheater, in accordance with the invention, has a flue gas sector, a primary air sector and a pair of secondary air sectors, each secondary air sector being adjacent to both the gas sector and the primary air sector.

The quad sector air preheater includes double sealing arrangements between the gas sector and the secondary air sectors, and single sealing arrangements between the primary air sector and each secondary air sector. More particularly, the sector plates between the gas sector and the two secondary air sectors are equal in size to two rotor compartments, therefore providing double seals therebetween. The sector plates between the primary air sector and the secondary air sectors are equal in size to one rotor compartment, providing a single seal therebetween. The sector plates, therefore, between the primary air sector and the secondary air sectors are one half the size of the sector plates between the flue gas sector and each secondary air sector.

The use of single seal sector plates between the primary and secondary air sectors reduces the blockage to air flow through the air sector of the preheater, therefore minimizing the pressure drop across the air preheater. Furthermore, the positioning of the primary air sector between the secondary air sectors results in direct leakage from the relatively higher pressure primary air sector only into the secondary duct rather than into the flue gas duct. The recovery of the direct leakage from the primary sector in the secondary duct therefore decreases the force draft fan size for the secondary sector an equivalent amount, thereby reducing the initial capital costs and continued operating costs of the furnace system.

Furthermore, positioning the relatively lower pressure secondary air sectors adjacent the flue gas sector reduces the air to gas leakage. The reduction in air sector to flue gas sector leakage reduces cooling of the flue gas. The resulting higher exit temperature of the flue gas decreases cold end corrosion while still providing equivalent heat transfer between the flue gas sector and the air sector.

DESCRIPTION OF THE PREFERRED EMBODIMENT

Figure 1:
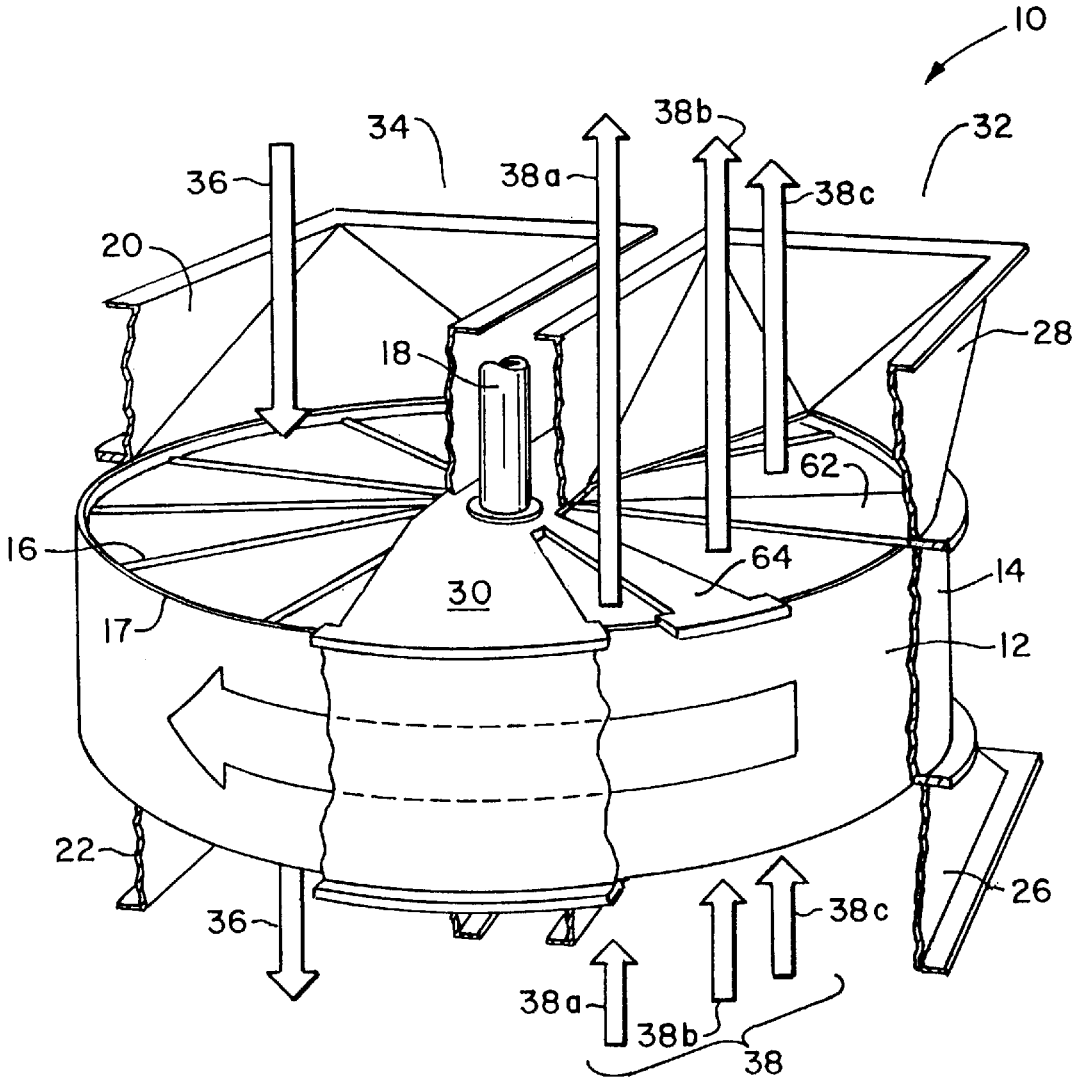
FIG. 1 is a perspective view, partially broken away, of a quad sector rotary regenerative air preheater in accordance with the invention.

With reference to the drawings, a rotary regenerative quad sector air preheater in accordance with the invention is generally designated by the numerical identifier 10. The air preheater 10 has a rotor 12 rotatably mounted in a housing 14. The rotor 12 is formed of radially extending diaphragms or partitions 16 extending radially from a center post 18 to the outer periphery of the rotor 12. The partitions 16 define compartments 17 therebetween containing heat exchange elements. Attached to the housing 14 is a flue gas inlet duct 20 and a flue gas outlet duct 22 for the flow of heated flue gases through the air preheater 10. Also attached to the housing 14 are a primary air inlet duct 24, secondary air inlet ducts 25, 26, a primary air outlet duct 27 and secondary air outlet ducts 28, 29 for the flow of combustion air through the preheater 10. (See FIGS. 1, 2 and 3)

Air-gas sector plates 30 extend across the housing 14 adjacent the upper and lower faces of the rotor 12. The air-gas sector plates 30 divide the air preheater 10 into an air sector 32 and a flue gas sector 34. The arrows of FIG. 1 indicate the direction of a flue gas stream 36 and the air streams 38. The air side 32 of the preheater 10 is subdivided by sector plates 62, 64, which are sometimes referred to as priair-secair sector plates, into a primary air sector 40 and a plurality of secondary air sectors 42, 44. (See FIG. 3) Therefore, the combustion air stream 38 is comprised of a primary air stream 38*b* and a plurality of secondary air streams 38*a*, 38*c*. The primary air steam 38*b* and secondary air streams 38*a*, 38*c* are directed into the primary air sector 40 and secondary air sectors 42, 44 by the primary air inlet duct 24 and secondary air inlet ducts 25, 26 respectively shown in FIG. 2. The primary air sector 40 is positioned between the secondary air sectors 42, 44 wherein the secondary air sectors are each adjacent to the flue gas sector 34 and the primary air sector 40. Therefore the primary air sector 40 is not adjacent the flue gas sector 34.

Figure 2:
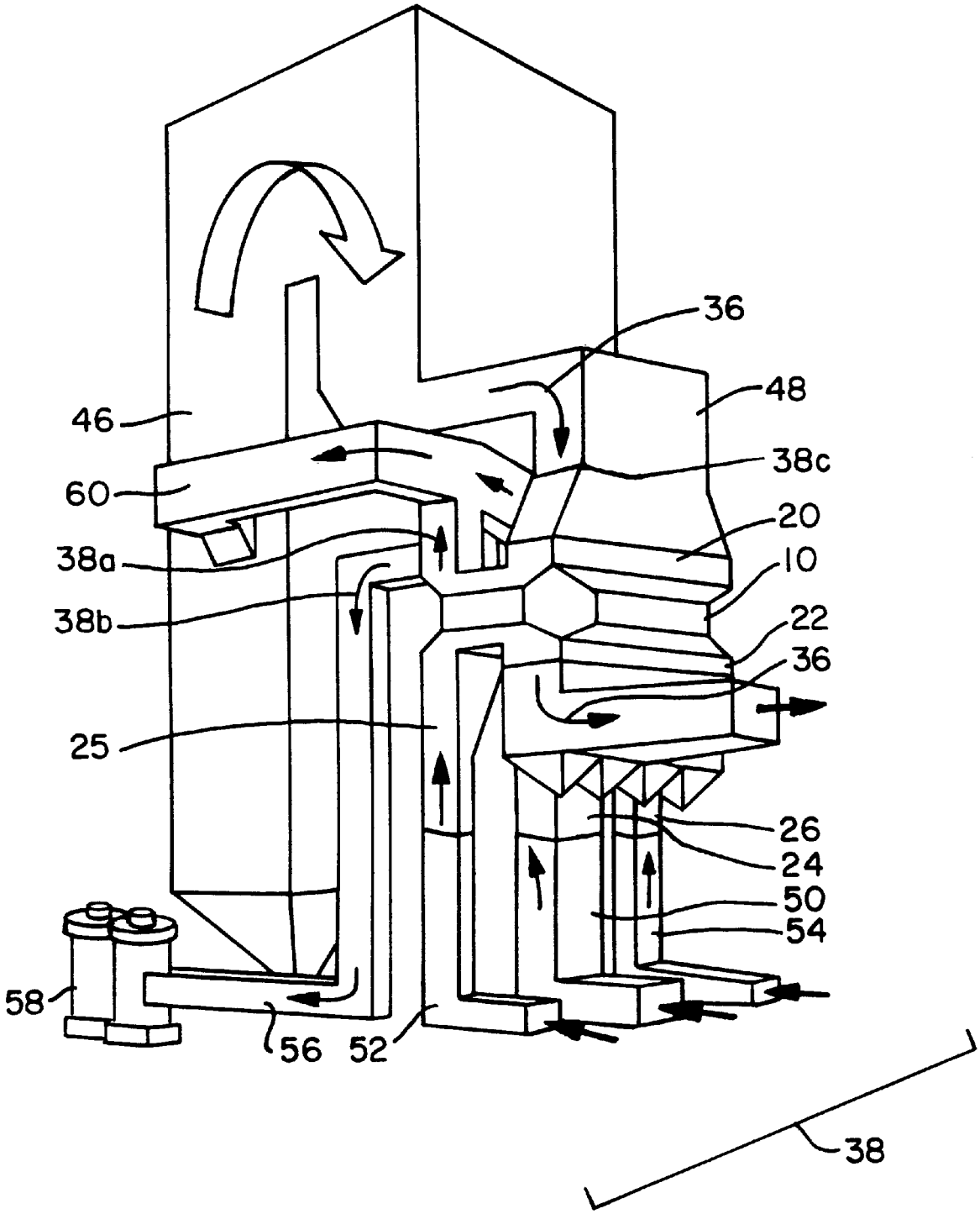
FIG. 2 is the schematic representation of the quad sector rotary regenerative air preheater of the present invention in combination with a pulverizer and furnace.
Figure 3:
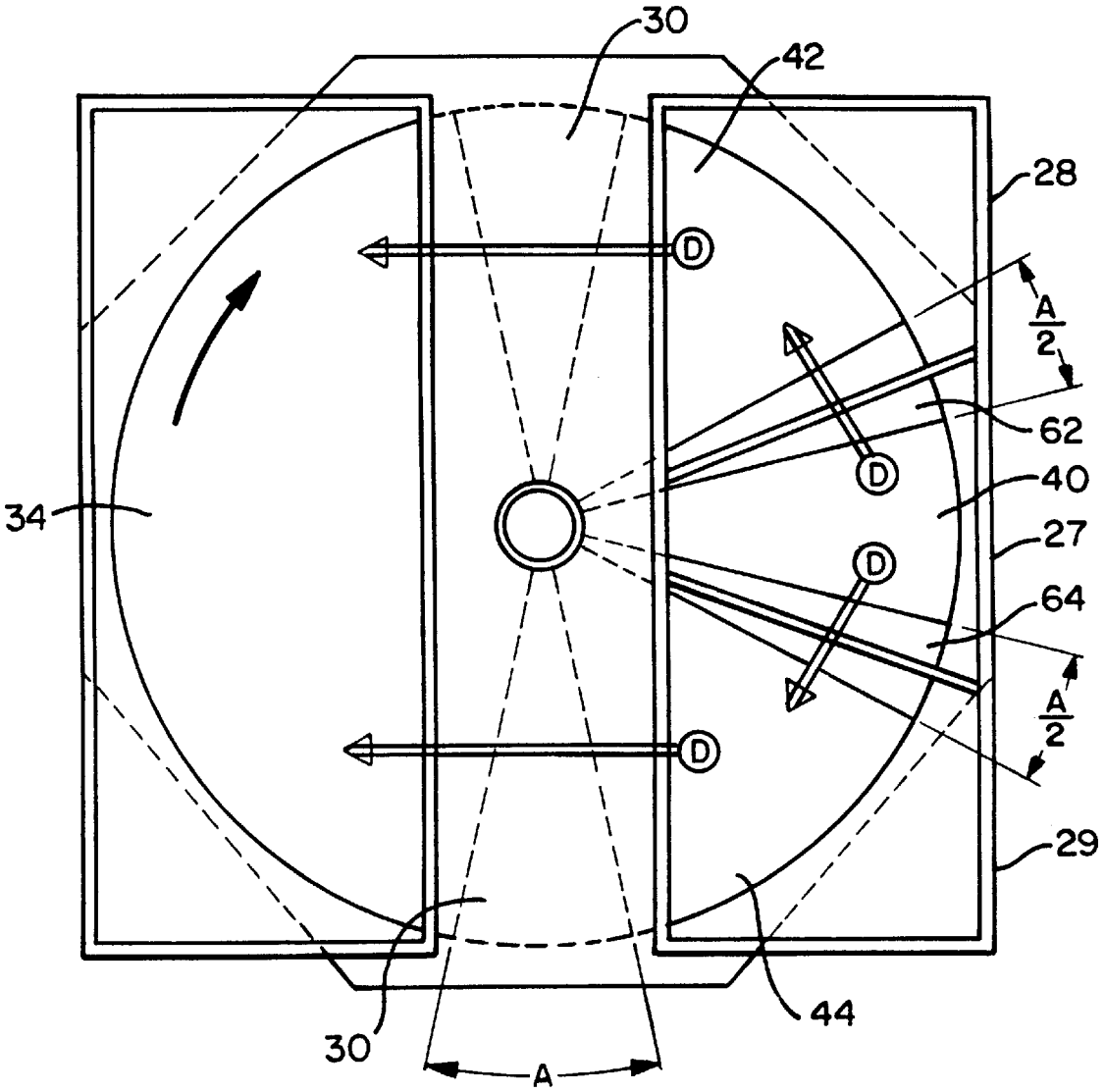
FIG. 3 is a top view, partially in phantom, of the quad sector air preheater of FIG. 1.
Figure 4:
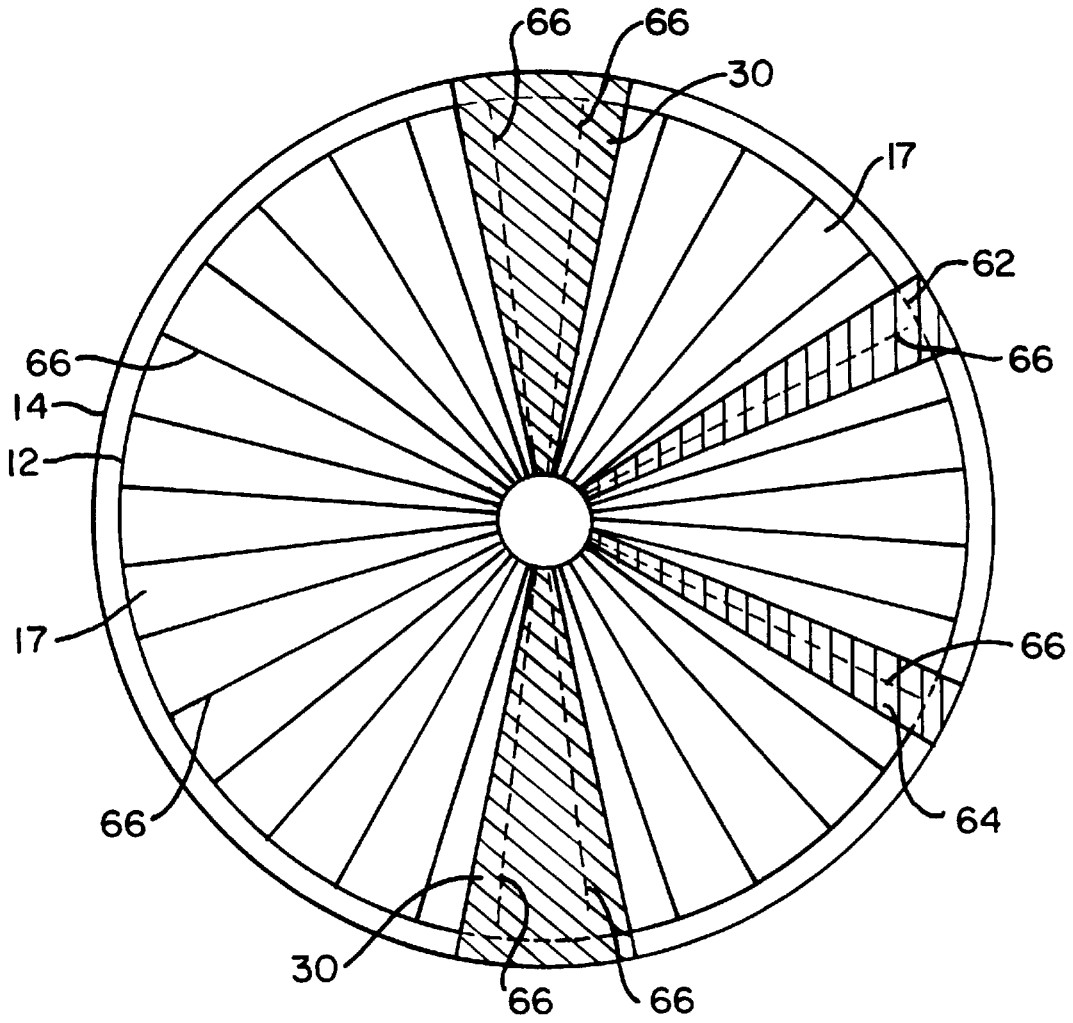
FIG. 4 is a simplified representation of the rotor and sector plates of the quad sector air preheater of FIG. 1.

With reference to FIG. 2, the air preheater 10 is shown in combination with a steam generator 46 for the generation of steam. Hot exhaust gas is directed from the steam generator 46 by a duct 48 to the flue gas sector 34 of the preheater 10. The hot flue gas stream 36 entering through the flue gas inlet duct 20 transfers heat to the heat transfer elements mounted in the compartments 17 between partitions 16 on the continuously rotating rotor 12. The heated heat transfer elements are then rotated to the air sector 32 of the air preheater 10. The unheated primary air stream 38*b* is directed into the air sector 32 of the preheater 10 by a duct 50 connected to the primary air inlet duct 24. The unheated secondary air streams 38*a*, 38*c* are directed into the preheater 10 by ducts 52, 54 connected to the secondary air inlet ducts 25, 26. The stored heat of the heat transfer elements is transferred to the combustion air stream 38 entering through the air inlet ducts 24, 25 and 26.

The heated primary air stream 38*b* exits the preheater 10 through the primary air outlet duct 27 and is directed by ducting 56 to pulverizers 58 employed for the pulverizing of coal for the steam generator 46. The primary air stream 38*b*, dries the coal, assists in the classification of coal fines in the pulverizer 58, and further transports the coal fines to the steam generator 46. The secondary air streams 38*a*, 38*c* exit the preheater 10 through secondary air outlet ducts 28, 29 and are directed by ducting 60 directly to the steam generator 46. The cooled flue gas stream 36 exits the preheater 10 through the flue gas outlet duct 22.

Radial seals 66 are affixed to the upper and lower edges of the partitions 16 for sealing between the sectors 34, 40, 42, 44. The radial seals 66 sealingly engage the air-gas sector plates 30, and the sector plates 62, 64 to reduce direct air leakage between the secondary air sectors 42, 44 and flue gas sector 34, and the primary air sector 40 and the secondary air sectors 42, 44 respectively. (See arrows shown in FIG. 3)

Figure 5:
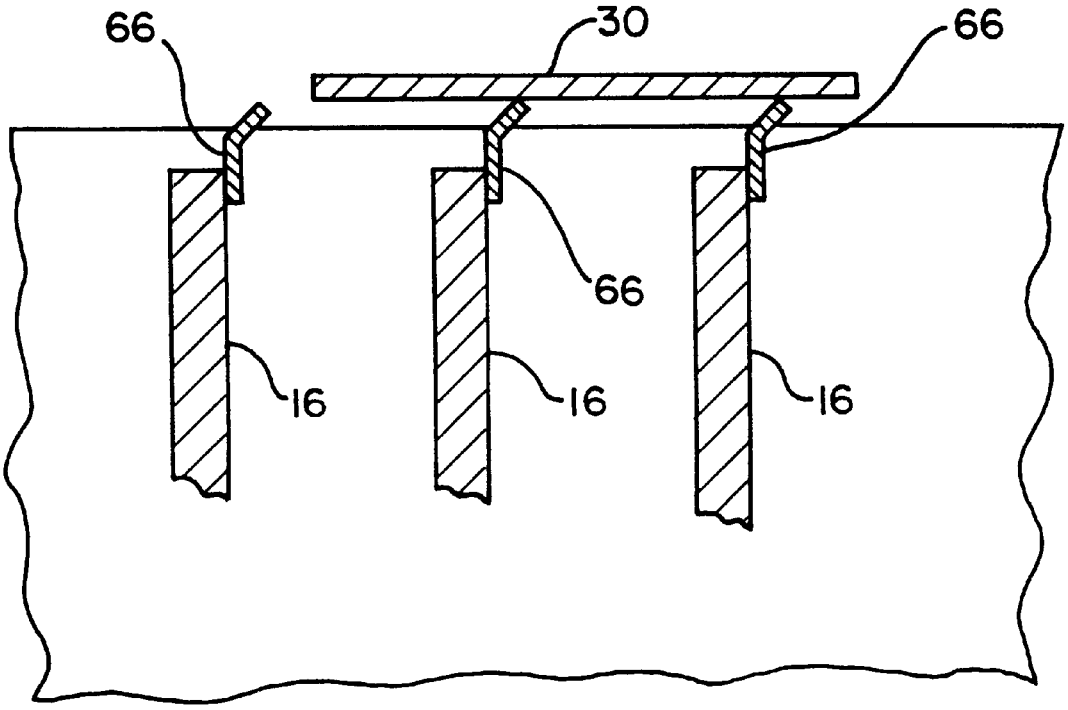
FIG. 5 is a cross-sectional view of a portion of the rotor and sector plate illustrating a double seal arrangement.
Figure 6:
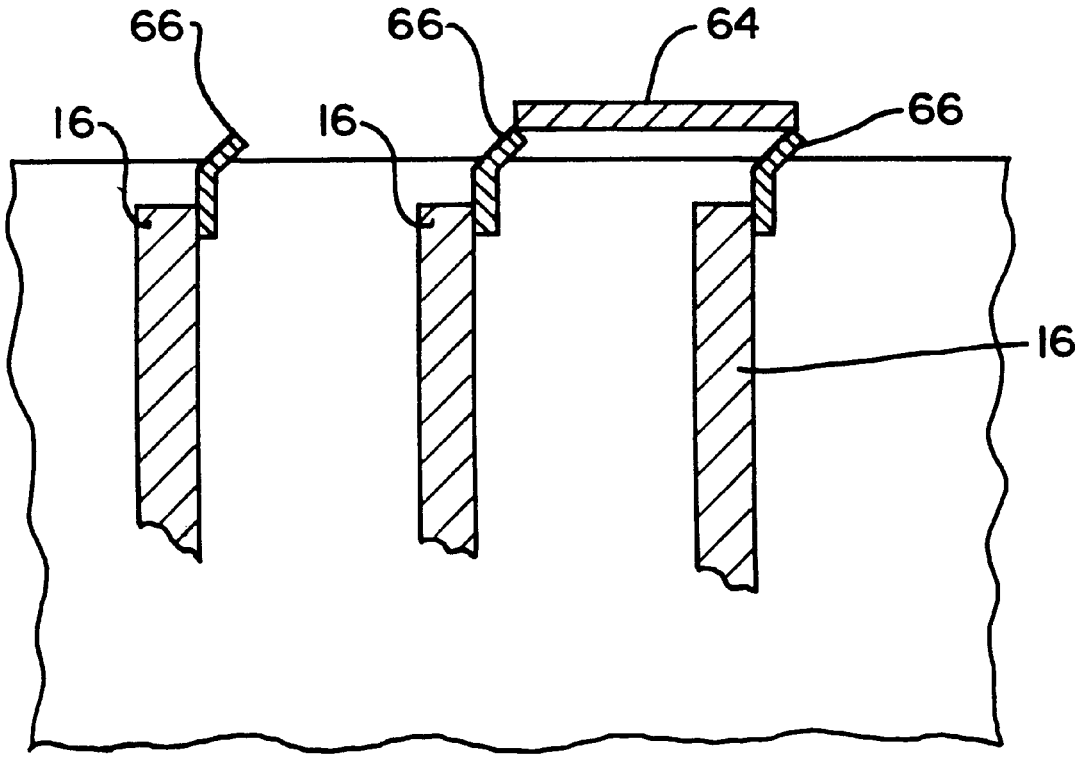
FIG. 6 is a cross-sectional view of a portion of a rotor and sector plate illustrating a single seal arrangement.

The air-gas sector plates 30 preferably define an angle A wherein the air gas sector plates 30 are sufficiently large to span two compartments such that two radial seals 66 are always in sealing engagement with the air-gas sector plates 30 as the rotor 12 rotates. (See FIGS. 3 and 5) However, in order for the air-gas sector plates 30 to be of sufficient size to provide a double seal, the air-gas sector plates 30 block a portion of the rotor 12. This blockage increases the pressure drop through the preheater 10. In order to reduce the pressure drop through the air sector 32 of the preheater, the primary air-secondary air sector plates 62, 64 provide only a single seal arrangement with the radial seals 66. The primary air-secondary air sector plates 62, 64 are only in contact with one radial seal 66 at any given time. (See FIGS. 3 and 6) Therefore, the so-called sector plates 62, 64 define generally half the angle of the air-gas sector plates 30 and only a single radial seal 66 is always in sealing engagement with these sector plates 62, 64 as the rotor rotates.

The single sealing arrangement of the priair-secair sector plates 62, 64 theoretically allows for greater direct leakage between the primary air sector 40 and the secondary air sectors 42, 44 relative to the direct leakage between the secondary air sectors 42, 44 and the flue gas sector 34 across the double seal of the air gas sector plates 30. However, the arrangement of the primary air sector 40 between the secondary air sectors 42, 44 provides for several operational advantages. Direct leakage of the primary air stream 38*b* from the primary air sector 40 to the secondary air sectors

42, 44 is recovered in the secondary air outlet ducts 28, 29, thus decreasing the forced draft fan size required for the secondary air streams 38*a,* 38*c* in the equivalent amount.

During conventional plant operation, the primary air stream 38*b* will be operated at a higher pressure than the secondary air streams 38*a,* 38*c.* The secondary air streams 38*a,* 38*c* are at an intermediate pressure between the primary air stream pressure and the flue gas stream pressure. Therefore, because the relative pressures between the secondary air streams 38*a,* 38*c* and the flue gas stream 36 are lower than the pressure differential between the primary air stream 38*b* and the flue gas stream 36, direct air leakage is reduced between the secondary air sectors 42, 44 and the flue gas sector 34. The reduced direct leakage, therefore, between the air sector 32 and the flue gas sector 34 results in lower dilution and cooling of the flue gas stream 36.

In an experimental comparison of a quad sector air preheater in accordance with the invention and a conventional trisector preheater, for similar performance characteristics, direct air leakage was reduced 37%. The reduced air to gas leakage decreases the dilution and cooling of the flue gas, therefore allowing a higher flue gas stream exit temperature. The increased exit temperature results in decreased cold end corrosion while still maintaining equivalent heat transfer between the flue gas stream and the primary and secondary air streams. Furthermore, the forced draft fan size can be decreased for lower initial and operational costs.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What we claim is:

1. A sealing arrangement for a quad sector rotary regenerative air preheater comprising:

a rotor housing;

a rotor rotatably mounted in said rotor housing having a plurality of radially extending diaphragms forming compartments in said rotor and having radial seals extending along the edges of said diaphragms;

sector plates positioned at both axial ends of said rotor dividing said air preheater into a flue gas sector, a primary air sector, a first secondary air sector adjacent said flue gas sector and said primary air sector, and a second secondary air sector positioned adjacent said flue gas sector and said primary air sector, said sector plates between said flue gas sector and said secondary air sectors being of a size to be in sealing engagement with two of said radial seals at all times, and said sector plates between said primary air sector and said secondary air sectors being of a size to be in sealing engagement with only one of said radial seals at any particular time.

* * * * *